United States Patent [19]

Spehrley, Jr.

[11] 4,187,969

[45] Feb. 12, 1980

[54] FIXED STAPLER HEAD

[75] Inventor: Charles W. Spehrley, Jr., Quechee, Vt.

[73] Assignee: Xerox Corporation, Stamford, Conn.

[21] Appl. No.: 905,665

[22] Filed: May 15, 1978

[51] Int. Cl.[2] ..... B27F 7/06

[52] U.S. Cl. ..... 227/2; 221/11; 221/104; 227/40

[58] Field of Search ..... 227/2, 3, 4, 5, 6, 7, 227/28, 30, 39, 40, 45, 99, 100, 101, 120; 221/11, 104, 119, 120, 121, 122

[56] References Cited

U.S. PATENT DOCUMENTS

| | | | |
|---|---|---|---|
| 1,907,849 | 5/1933 | Maynard | 227/120 |
| 2,117,743 | 5/1938 | Polzer | 227/120 |
| 3,189,220 | 6/1965 | Mullaney | 227/120 |
| 3,380,639 | 4/1968 | DeFrancis et al. | 227/4 |
| 3,672,414 | 8/1971 | Garfinkel | 227/56 X |
| 3,685,712 | 8/1972 | Turner et al. | 227/3 |
| 3,938,697 | 2/1976 | Kinney | 221/11 |

*Primary Examiner*—Paul A. Bell

*Attorney, Agent, or Firm*—J. J. Ralabate; C. A. Green; H. Fleischer

[57] ABSTRACT

An apparatus in which a stack of sheets is brought into contact with the clamping surface of a fixed stapler head. After the stack is secured against the clamping surface, a staple is driven therethrough.

6 Claims, 3 Drawing Figures

FIXED STAPLER HEAD

The foregoing abstract is neither intended to define the invention disclosed in the specification, nor is it intended to be limiting as to the scope of the invention in any way.

BACKGROUND OF THE INVENTION

This invention relates to an electrophotographic printing machine, and more particularly concerns an improved stapling apparatus for use therein.

In the process of electrophotographic printing, a photoconductive member is charged to a substantially uniform level to sensitize the surface thereof. Thereafter, the charged photoconductive member is exposed to a light image of an original document being reproduced. Exposure of the charged photoconductive surface discharges the charge selectively in the irradiated areas. This records an electrostatic latent image on the photoconductive surface corresponding to the informational areas contained within the original document being reproduced. After the electrostatic latent image is recorded on the photoconductive surface, the latent image is developed by bringing a developer mix into contact therewith. The developer mix is brought into contact with the latent image, the greater attractive force thereof causes the toner particles to be attracted from the carrier granules of the developer mix to the latent image. Thereafter, the toner powder image is transferred to the copy sheet and permanently affixed thereto. This general approach was originally disclosed by Carlson in U.S. Pat. No. 2,297,691 and has been further amplified and described by many related patents in the art.

Frequently, it is desirable to reproduce a set of original documents as a plurality of sets of copies. This is generally achieved by employing a recirculating document handling system in association with the electrophotographic printing machine. The recirculating document handling system is positioned on the platen of the printing machine and advances successive original documents thereto. The original documents disposed on the platen are exposed and, subsequently reproduced. After being copied, each original document is returned to the stack of original documents so that it may be re-imaged for the next successive copying cycle. In this manner, collated sets of copies or booklets may be formed. Each set of copies corresponds to the set of original documents. The copy sheets of a specific booklet are stapled to one another. In high speed electrophotographic printing machines, it is highly desirable to utilize a stapling apparatus that possesses a storage compartment for extra staples. This minimizes the frequency of staple loading and reduces machine maintenance. Heretofore, it was necessary to shut the machine down after the staples in the stapling apparatus were depleted. However, with the utilization of a magazine storing an extra supply of staples, the down time of the printing machine is significantly reduced. In order to employ a magazine for automatically injecting new staples into the stapling head, it is advantageous to fix the stapler head. Previously, the stapling head pivoted during the stapling operation.

Accordingly, it is the primary object of the present invention to improve the stapling apparatus employed in an electrophotographic printing machine.

PRIOR ART STATEMENT

Various types of devices have hereinbefore been developed to improve stapling machines. The following prior art appears to be relevant.

Maynard; U.S. Pat. No. 1,907,849; May 9, 1933.
Polzer; U.S. Pat. No. 2,117,743; May 17, 1938.
Garfinkel; U.S. Pat. No. 3,672,414; Aug. 31, 1971.

The pertinent portions of the foregoing prior art may be briefly summarized as follows:

Maynard discloses a stapling machine employing a generally horizontal base having a stapling arm mounted pivotably at its rearward end. The stapling mechanism is mounted on the forward end of the stapling arm. The forward end of the base includes a suitable clinching device.

Polzer also describes a stapling machine having a housing mounted pivotably at its rearward portion on a base. The stapling mechanism is mounted on the forward end of the housing with the clinching device opposed therefrom on the base.

Garfinkel describes a container holding a helically wound belt of staples.

It is believed that the scope of the present invention, as defined by the appended claims, is clearly patentably distinguishable over the foregoing prior art taken either singly or in combination with one another.

SUMMARY OF THE INVENTION

Briefly stated, and in accordance with the present invention, there is provided an apparatus for driving a staple through a stack of sheets.

Pursuant to the features of the invention, the apparatus includes a housing having a passageway for storing therein at least one staple. The housing is held stationarily and has a clamping surface. Means are provided for moving the stack of sheets into contact with the clamping surface of the housing. The stack of sheets is held securely against the clamping surface during the stapling operation. Means drive the staple stored in the passageway of the housing through the stack of clamped sheets.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it wil be understood that it is not intended to limit the invention to that embodiment. On the contrary, it is intended to cover all alternatives, modifications, and equivalents as may be included within the spirit and scoe of the invention as defined by the appended claims.

DETAILED DESCRIPTION OF THE INVENTION

Figure 1:
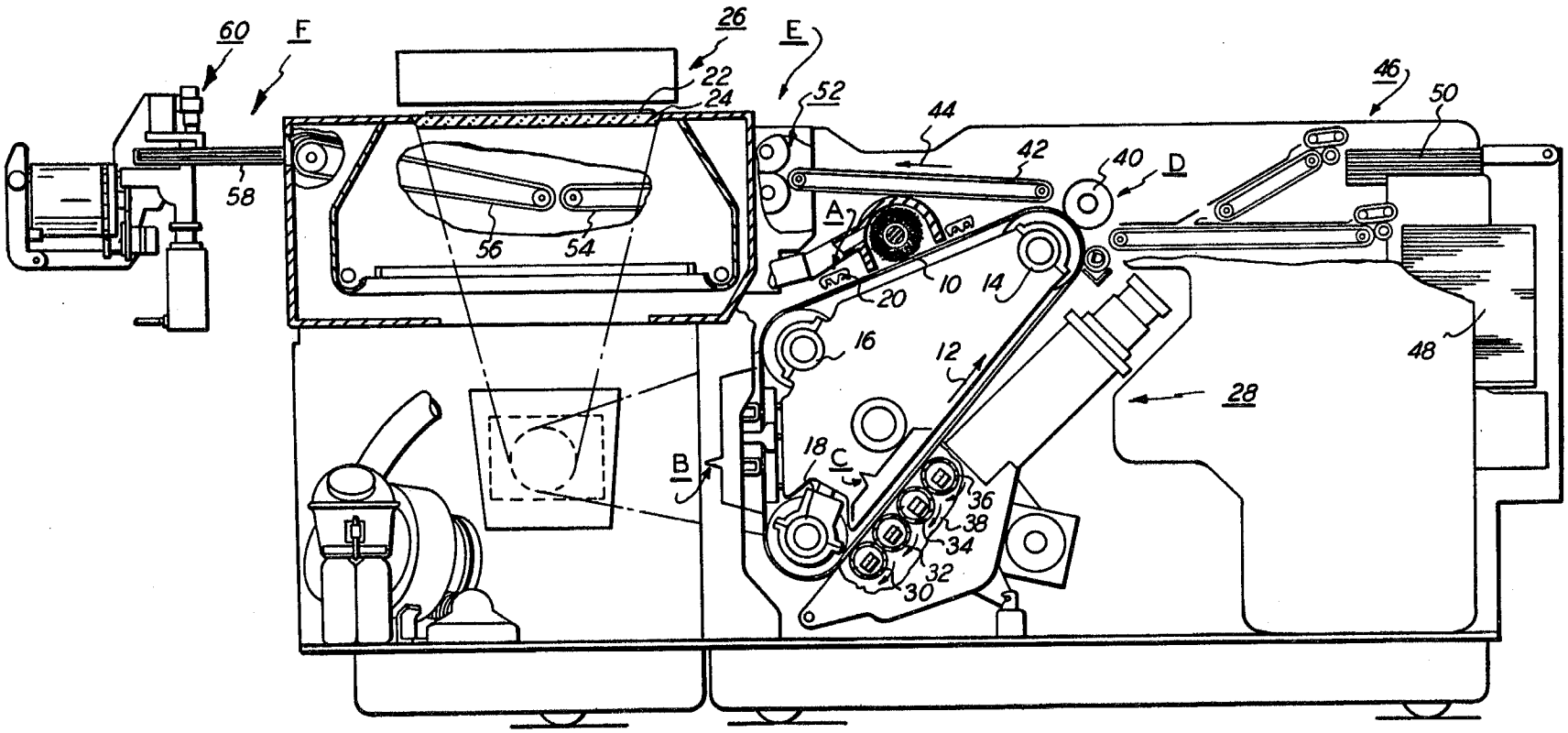
FIG. 1 is a schematic elevational view of an electrophotographic printing machine incorporating the features of the present invention therein.

In order to more fully understand the illustrative electrophotographic printing machine incorporating the features of the present invention therein, reference is made to the drawings. In the drawings, like reference numerals have been used throughout to designate identical elements. FIG. 1 schematically illustrates the various components of an electrophotographic printing machine incorporating the stapling apparatus of the present invention therein. Although the stapling apparatus is particularly well adapted for use in an electrophotographic printing machine, it will become evident from the following discussion that it is equally well suited for use in a wide variety of machines and is not necessarily limited in its applications to the particular embodiment shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface, e.g., a selenium alloy, deposited on a conductive substrate, e.g., aluminum. As shown in FIG. 1, belt 10 moves in the direction of arrow 12 to advance sequentially through the various processing stations positioned about the path of movement thereof. Rollers 14, 16 and 18 support belt 10. A drive mechanism, i.e., a suitable motor, is coupled to roller 14 and advances belt 10 in the direction of arrow 12.

Initially, a portion of the photoconductive surface of belt 10 passes through charging station A. Preferably, charging station A includes a corona generating device, indicated generally by the reference numeral 20, to charge the photoconductive surface of belt 10 to a relatively high substantially uniform potential. A suitable corona generating device is described in U.S. Pat. No. 2,836,725 issued to Vyverberg in 1958.

Next, the charged portin of the photoconductive surface of belt 10 advances through exposure station B. At exposure station B, a recirculating document handling systems 26 present original documents 22 one at a time to a exposure platen 24 and returns the originals to the stack thereof. After the original document is exposed, it is returned to the stack of original documents. A suitable recirculating document handling system is described in British Pat. No. 1,492,466, the relevant portions thereof being hereby incorporated into the present application. Original document 22 is positioned faced down on platen 24 and a lamp flashes light rays thereupon. The light rays reflected from original document 22 are transmitted through the optics of the exposure system forming a light image containing the informational areas of the original document thereon. The optics, e.g., a suitable lens and mirrors, project the light image onto the charged portion of belt 10. In this manner, the charged portion of the photoconductive surface of belt 10 is discharged selectively by the light image of the original document. This records an electrostatic latent image on the photoconductive surface of belt 10 which corresponds to the informational areas contained within original document 22.

Thereafter, belt 10 advances the electrostatic latent image recorded thereon to development station C. At development station C, a developer unit 28 includes a plurality of magnetic brush developer rollers 30, 32, 34 and 36 disposed in housing 38. These developer rollers advance the developer mix into contact with the electrostatic latent image recorded on the photoconductive surface of belt 10. In a system of this type, a chain-like array of developer mix extends in an outwardly direction from each developer roller to contact the electrostatic latent image recorded on the photoconductive surface of belt 10. The latent image attracts the toner particles from the carrier granules forming a toner powder image on belt 10.

The toner powder images are transported by belt 10 to transfer station D. Transfer station D is located at a point of tangency on belt 10 as it moves around roller 14. A transfer roller 40 is disposed at transfer station D with the copy sheet being interposed between transfer roller 40 and belt 10. Transfer roller 40 is electrically biased to a suitable magnitude and polarity so as to attract the toner powder image from belt 10 to the surface of the copy sheet in contact therewith. After transferring the toner powder image to the copy sheet, conveyor 42 advances the copy sheet in the direction of arrow 44 to fixing station E.

Prior to proceeding with the remaining processing stations, the sheet feeding apparatus will be described briefly. The sheet feeding apparatus includes a sheet transport 46 which advances, in seriatum, successive copy sheets from stack 48, or, in lieu thereof, stack 50. The machine programming enables the operator to select the desired stack from which the copy sheet will be advanced. Thus, the selected copy sheet is advanced to transfer station D where the toner powder image adhering to the photoconductive surface of belt 10 is transferred thereto.

After the toner powder image has been transferred to the copy sheet, conveyor 42 advances the copy sheet in the direction of arrow 44 to fixing station E. Fixing station E includes a fuser assembly, indicated generally by the reference numeral 52. Fuser assembly 52 comprises a heated fuser roller and a back-up roll. The copy sheet having the toner powder image thereon passes between the fuser roll and back-up roll with the toner powder image contacting the fuser roll. In this manner, the toner powder image is permanently affixed to the copy sheet. After fusing, conveyors 54 and 56 advance the copy sheet to finishing station F.

Finishing station F includes an output tray 58 and a stapling apparatus 60. The stapling apparatus includes one or two staplers each of which is manually adjustable to discrete positions corresponding to the paper sizes which may be used in the printing machine. Either staple or both staplers may be selected for stapling. Inasmuch as both staplers are identical to one another, only one stapler will be described hereinafter. The detailed structure of the stapling apparatus will be described with reference to FIGS. 2 and 3. After all of the original documents have been reproduced, the stack of copy sheets in tray 58 are stapled to one another by stapling apparatus 60. Thereafter, the operator may remove the finished booklet of copy sheets therefrom. Although only one output tray is depicted, a plurality of such output trays may be employed as well as a corresponding number of staplers associated therewith.

It is believed that the foregoing description is sufficient for purposes of the present application to illustrate the general operation of an electrophotographic printing machine incorporating the features of the present invention therein. Referring now to the specific subject matter of the present invention, FIG. 2 depicts the stapling apparatus, in detail, employed in the FIG. 1 printing machine.

Figure 2:
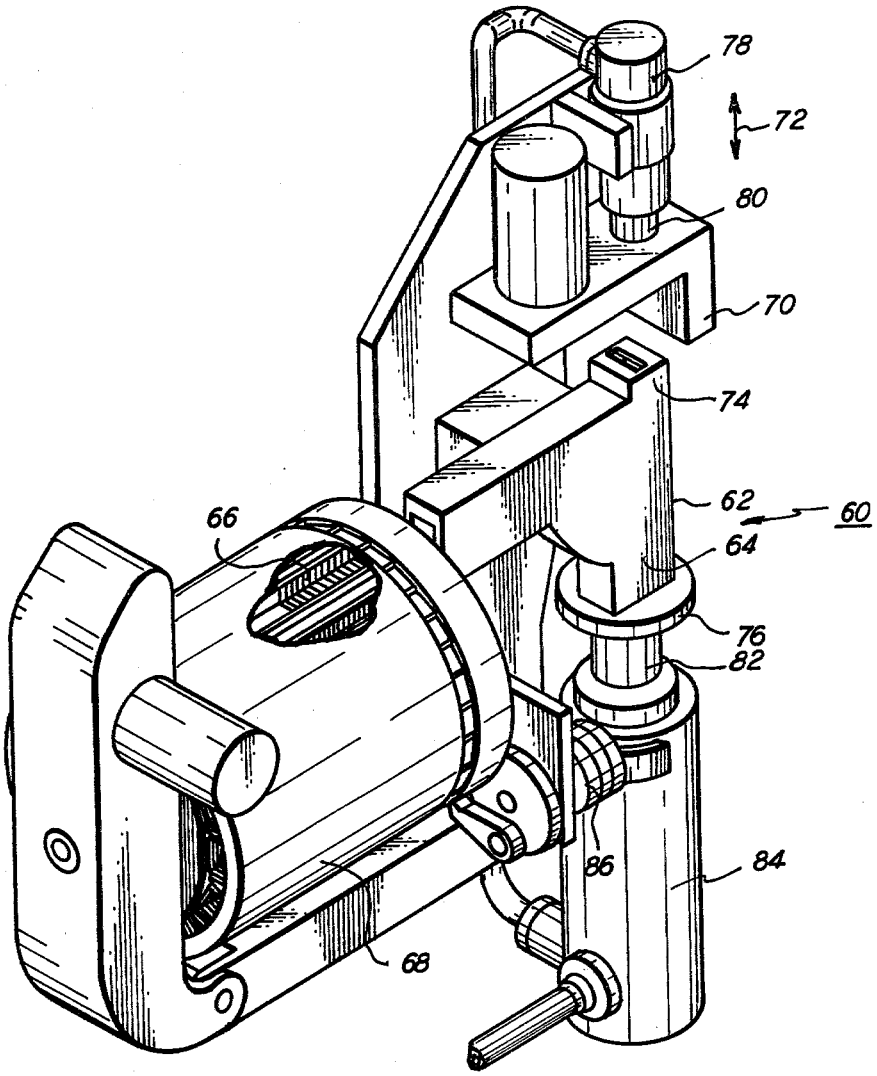
FIG. 2 is a schematic perspective view of a stapling apparatus employed in the FIG. 1 printing machine.

Turning now to FIG. 2, there is shown the detailed structure of stapling apparatus 60. As depicted thereat, stapling apparatus 60 includes a stapler head 62. Preferably, stapler head 62 is a modified stapler head which corresponds to Model No. 62E manufactured by the Bostitch Corporation. Stapler head 62 comprises a housing 64 having a passageway therein for receiving a stick of staples 66 from cassette 68. Stapler head 62 is mounted fixedly and remains stationary during its operation. The stack of copy sheets is supported at least partially on clamper 70. Clamper 70 translates in the direction of arrow 72. In this amnner, clamper 70 moves in the direction of arrow 70 toward clamping surface 64 of stapler housing 64. Clamper 70 presses the stack of copy sheets into engagement with surface 74 of housing 64. After the stack of copy sheets has been clamped between clamper 70 and surface 74 of housing 64, ram 76 of stapler 62 is actuated to drive a staple through the stack of copy sheets.

In operation, both the clamper 70 and ram 76 are actuated by a pneumatic system. The pneumatic system comprises a cylinder 78 having a plunger 80 connected to clamper 70. Similarly, ram 76 is connected to plunger 82 of cylinder 84. A suitable valving system introduces pressurized fluid into cylinder 78 causing plunger 80 to move clamping surface 70 so that the stack of copy sheets are sandwiched between clamper 70 and surface 74 of housing 64. Thereafter, pressurized fluid is introduced into cylinder 84 driving plunger 82 so that ram 76 shears a staple from the stick thereof in the passageway of housing 64 and drives the staple through the stack of copy sheets. Clamper 70 may have a transverse slot in which is mounted an anvil. In the top of the anvil are the usual staple prong clinching recesses. The staple prong clinching recesses are positioned opposed from surface 74 and in alignment with the staple legs so as to clinch the legs thereat. Alternatively, an active clincher assembly may be employed which comprises a pair of pivoted clinchers. These clinchers pivot their free ends into engagement with the staple legs to bend the legs of the staple and clinch them against the stack of copy sheets as the staple ram completes the driving action. In either case, the staple legs are clinched against the stack of copy sheets. This results in the formation of a booklet of copy sheets corresponding to the set of original documents being reproduced.

Cassette 68 is mounted fixedly on stapler 62 and is positioned so that the stick of staple 66 therein is in alignment with the passageway in housing 64 of stapler head 62. After the quantity of staples in the passageway of housing 64 is beneath a predetermined quantity, a solenoid associated with cassette 68 is actuated. The solenoid moves the stick of staple 66 along a guideway in cassette 66 into the passageway in housing 64 of a stapler head 62. As shown in FIG. 2, cassette 68 comprises an inner cylinder having a plurality of sticks of staples 66 disposed thereabout and arranged in a turret-type configuration. After one stick of staples is advanced into the passageway of housing 64, motor 86 indexes the next stick of staples into alignment with the passageway in housing 64. In this manner, the next successive stick of staples is positioned to be received by the passageway in housing 64 when the quantity of staples in the prior stick is beneath a predetermined quantity.

Figure 3:
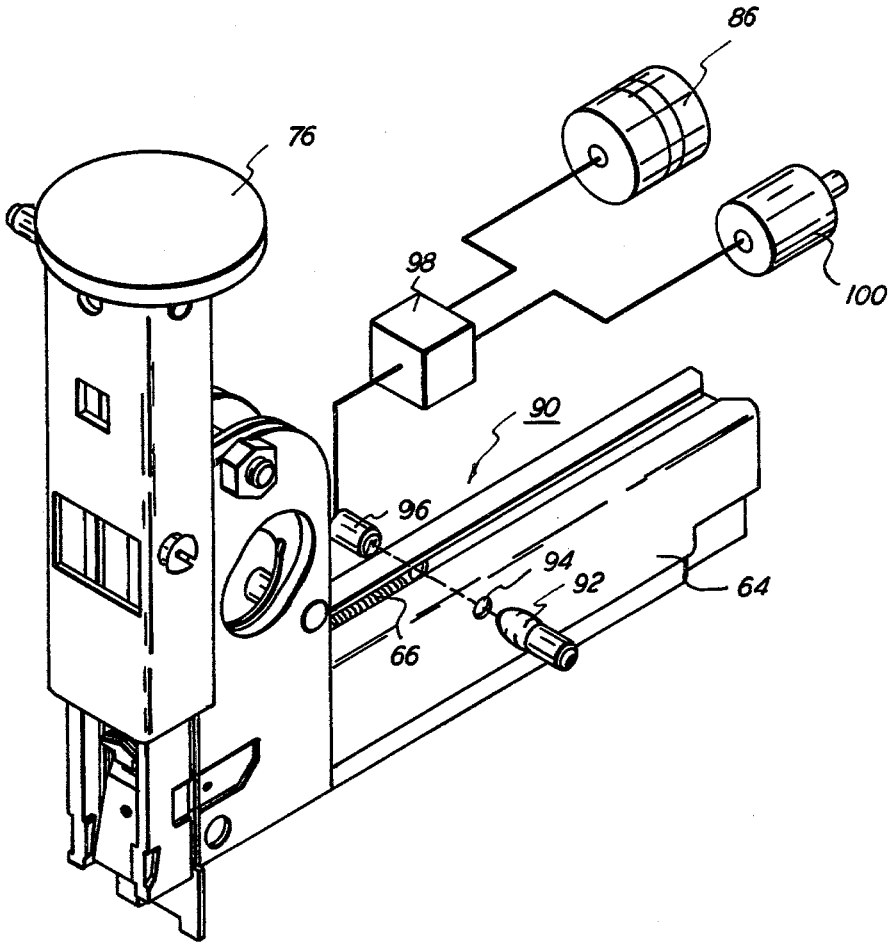
FIG. 3 is a schematic perspective view of a stapling head utilized in the FIG. 2 stapling apparatus.

Referring now to FIG. 3, there is shown the detailed operation of stapler head 62. As depicted therein, a stick of staples 66 is positioned in passageway 88 of housing 64. Driver 87 shears a staple from stick 66 and drives it through the stack of copy sheets. After the quantity of staples in stick 66 has been depleted to a predetermined quantity, the next successive stick of staples is advanced into passageway 88 from cassette 68. A staple detecting system determines the quantity of staples within passageway 88. The staple detecting system 90 comprises a light source 92 directing light rays through aperture 94 in housing 64. The light rays pass through passageway 88 and are received by photodiode 96. Photodiode 96 develops an electrical output signal which indicates that the number of staples in stick 66 beneath a predetermined quantity. Alternatively, if stick 66 blocks aperture 94, the light rays from light source 92 are prevented from reaching photodiode 96 and an electrical signal is not generated. The electrical output signal from photodiode 96 is processed by logic circuitry 98. Logic circuitry 98, preferably, includes a suitable discriminator circuit for comparing a reference with the electrical output signal from photodiode 96. The discriminator circuit may utilize a silicone control switch which turns on and effectively locks in after an electrical output signal having a magnitude greater than the reference level is obtained. The signal from the discriminator circuit transmits a control signal to motor 86 and solenoid 100. Solenoid 100 is initially activated to move a plunger having a stick of staples thereon. This plunger is located in cassette 68 and, in this manner, the stick of staples is advanced into passageway 88 of stapler housing 64.

By way of example, light source 92 is, preferably, a tungsten filament lamp operating from a 5 volt source. Photosensor 96 is a commercially available silicone phototransistor such as is produced by the General Electric Co., Model No. L14D.

It should be noted that after motor 86 indexes the next successive stick of staples into alignment with passageway 88 of housing 64, a reset signal is generated resetting the silicone control switch of the discriminator circuit of logic circuit 98. This permits a new electrical output signal to be generated when the number of staples remaining in passageway 88 of housing 64 is beneath a predetermined quantity. As previously indicated, this signal actuates the solenoid associated with the cassette for advancing the next successive stick of staples into passageway 88. Thereafter, an indexing motor rotates the next stick of staples into alignment with passageway 88. Thus, successive sticks of staples may be advanced into the stapler head. This decreases the down time for the stapling apparatus and increases the time between operator calls.

In recapitulation, it is apparent that the electrophotographic printing machine heretofore described, employs a finishing station having a stationary stapler head with a cassette of staples associated therewith. A clamping mechanism moves the stack of copy sheets into engagement with a reference surface on the stapling apparatus. Thereafter, a staple is driven through the set of copy sheets forming a booklet thereof corresponding to the set of original documents being reproduced in the printing machine.

It is, therefore, evident that there has been provided, in accordance with the present invention, a stapling apparatus that fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations that fall within the spirit and broad scope of the appended claims.

What is claimed is:

1. An apparatus for driving a staple through a stack of sheets, including:

a housing having a passageway for storing therein at least one staple, said housing being mounted stationarily and having a clamping surface;

means for moving the stack of sheets into contact with the clamping surface of said housing to hold the stack of sheets securely during the stapling operation;

means for driving the staples stored in the passageway of said housing through the stack of sheets;

means for storing a plurality of staples, said storing means being stationary and in communication with the passageway in said housing for periodically advancing a supply of staples thereto; and means, in communication with said housing, for detecting the quantity of staples remaining in the passageway of said housing and actuating said storing means to advance staples therefrom into the passageway of said housing when the quantity of staples contained within the passageway of said housing is less than a pre-determined number.

2. An apparatus as recited in claim 1, further including means for clinching the portion of the staple legs protruding through the stack of sheets.

3. An apparatus as recited in claim 2, wherein said detecting means includes:

a light source transmitting light rays into the passageway of said housing in a direction substantially normal thereto; and a photosensor positioned to receive the light rays transmitted from said light source when the staples in the passageway of said housing are less than the predetermined number.

4. A reproducing machine for producing stapled piles of copies from documents advanced from a supply source to a platen and then returned to the supply source in repeated cycles with the copies being stapled in sets corresponding to the documents being copied, wherein the improved stapling apparatus includes:

a housing having a passageway for storing therein at least one staple, said housing being mounted stationarily and having a clamping surface;

means for moving a set of copy sheets into contact with the clamping surface of said housing to hold the set of copy sheets securely during the stapling operation;

means for driving the staples stored in the passageway of said housing through the set of copy sheets;

means for storing a plurality of staples, said storing means being stationary and in communication with the passageway in said housing for periodically advancing a supply of staples thereto; and means, in communication with said housing, for detecting the quantity of staples remaining in the passageway of said housing and actuating said storing means to advance staples therefrom into the passageway of said housing when the quantity of staples contained within the passageway of said housing is less than a pre-determined number.

5. A reproducing machine as recited in claim 4, further including means for clinching the portion of the staple legs protruding through the set of copy sheets.

6. A reproducing machine as recited in claim 5, wherein said detecting means includes:

a light source transmitting rays into the passageway of said housing in a direction substantially normal thereto; and a photosensor positioned to receive the light rays transmitted from said light source when the staples in the passageway of said housing are less than the predetermined number.

* * * * *